United States Patent [19]

Roberts et al.

[11] 4,070,709

[45] Jan. 24, 1978

[54] PIECEWISE LINEAR PREDICTIVE CODING SYSTEM

[75] Inventors: John E. Roberts, Lexington; Richard H. Wiggins, Burlington, both of Mass.

[73] Assignee: The United States of America as represented by the Secretary of the Air Force, Washington, D.C.

[21] Appl. No.: 731,608

[22] Filed: Oct. 13, 1976

[51] Int. Cl.[2] ..... G06J 1/00; G10L 1/06

[52] U.S. Cl. ..... 364/602; 179/1 SA; 179/15.55 R; 325/38 B

[58] Field of Search ..... 235/150.53, 193, 152, 235/156; 179/1 SA, 1 SC, 15.55 R, 15.55 T, 15 AV, 15 BW; 325/38 R, 38 B, 38 A, 141; 332/11 D

[56] References Cited

U.S. PATENT DOCUMENTS

| | | | |
|---|---|---|---|
| 3,502,986 | 3/1970 | Lucky | 325/38 B X |
| 3,740,476 | 6/1973 | Atal | 179/1 SA |
| 3,927,268 | 12/1975 | Sciulli et al. | 179/15 BW |
| 3,973,081 | 8/1976 | Hutchins | 179/1 SA |
| 3,973,199 | 8/1976 | Widmer | 325/38 B |

OTHER PUBLICATIONS

Boxall-"Time-Shared Codes For Multichannel Delta Modulation and Differential PCM"-IEEE Transactions on Communications-vol. Com-23, No. 3, Mar. 1975, pp. 367-378.

*Primary Examiner*—Joseph F. Ruggiero
*Attorney, Agent, or Firm*—Joseph E. Rusz; Willard R. Matthews, Jr.

[57] ABSTRACT

Improved fidelity and reduced computational requirements are achieved in a linear predictive coding (LPC) system that utilizes multichannel signal processing and reduced sampling rates. The input analog signal is divided by filters into multiple, contiguous, substantially equal bandwidth signal components and each component is digitized and processed by a separate standard LPC transmit-receive system. Each transmit-receive system operates at a sampling rate that is equal to the normal sampling rate for the signal being processed divided by the number of channels or signal components used. The received signal components are filtered, converted to analog, and summed.

3 Claims, 10 Drawing Figures

PIECEWISE LINEAR PREDICTIVE CODING SYSTEM

STATEMENT OF GOVERNMENT INTEREST

The invention described herein may be manufactured and used by or for the Government for governmental purposes without the payment of any royalty thereon.

BACKGROUND OF THE INVENTION

This invention relates to digital speech compression systems, and in particular to systems of that type that utilize linear predictive coding techniques.

A great deal of current research in the area of narrow band digital speech compression makes use of some form of linear predictive coding (LPC) to extract on the order of 10 to 12 parameters approximately 50 times a second to specify the speech spectrum. In a typical implementation, the input speech waveform in analog low pass filtered to about 3200 Hz, analog-to-digital converted at about 6400 Hz with LPC analysis done in a digital signal processor using 16 bit fixed-point arithmetic.

The most time consuming data processor tasks are the formation of correlation coefficients (usually using double-precision accumulation) in the analyzer, and the synthesis of the output speech using a recursive filter. Although it has been recognized that reduction of the computation load for analysis and synthesis in these systems would provide improved fidelity and also permit the use of smaller and cheaper computer processing units, no effective means for such reduction have yet been devised. The present invention is directed toward achieving such an improvement in linear predictive coding systems.

SUMMARY OF THE INVENTION

The invention comprehends a technique for operating an LPC system that splits the input signal spectrum into two or more equal segments and performs a piecewise LPC approximation to each segment. In one preferred embodiment a low pass filter and a bandpass filter divide the analog voice signal into two equal spectrum signals of 0–1600 Hz and 1600–32 Hz. The 1600–3200 Hz signal is digitized at a 3200 sample/second rate (causing spectrum folding of the signal), processed by a conventional LPC transmit/receive system, digital-to-analog converted at a 3200 sample/second rate and band pass filtered by a 1600–3200 Hz analog filter. The 0–1600 Hz signal is processed in the normal manner, filtered by a low pass (0–1600 Hz) filter and summed with the 1600–3200 Hz output signal.

It is a principal object of the invention to provide a new and improved linear predictive coding system.

It is another object of the invention to provide means for reducing the computation load for analysis and synthesis in linear predictive coding systems.

It is another object of the invention to provide a high fidelity linear predictive coding system having smaller and cheaper computer processing unit requirements than standard systems.

These, together with other objects, features and advantages of the invention will become more readily apparent from the following detailed description when taken in conjunction with the accompanying drawings.

DETAILED DESCRIPTION OF THE PREFERRED EMBODIMENTS

The present invention comprises a piecewise linear predictive coding system (PLPC) and constitutes an improvement on standard linear predictive coding systems (LPC). Standard linear predictive coding systems are well known and are described in detail in the periodical articles, "Speech Analysis and Synthesis by Linear Prediction of the Speech Wave", by B. S. Atal and S. L. Haneuer, *Journal Acoustical Society of America,* 50, 2, (1971) pp 637–655, and "On Autocorrelation Equations as Applied to Speech Analysis", by J. D. Markel and A. H. Gray, *IEEE Transistors on Audio Electroacoustics,* AU-20, (1973) pp 69–79. The PLPC system of the invention in its broadest sense comprehends dividing the input signal into N contiguous, substantially equal bandwidth components, separately processing these segments with standard LPC transmit/receive circuits operated at a sampling rate of $2 f_{max}/N=$ sample/second ($f_{max}$ being the upper limit frequency of the input signal spectrum) and recombining the several outputs.

In the particular embodiment hereinafter described, the input speech is split into two channels (0–1600 Hz and 1600–3200 Hz) using analog filters. Two independent LPC processes are then performed on these channels at a 3200 sample per second rate. Since each of the LPCs are working on one-half the speech spectrum, it is possible to reduce the order of the LPCs with no loss in fidelty. If the order is halved, the PLPC computation load for analysis and synthesis is reduced approximately by a factor of two:

LPC: (1 LPC) * (6400 s/s) * (N-ORDER) * K=6400 * N * K

PLPC: (2 LPC) * (3200 s/s) * (N/2-ORDER) * K=3200 * N * K, where K is the same constant for both methods. Other important tasks such as pitch extraction require the same amount of computation for both systems.

In addition to the reduction in computation requirements the piecewise linear predictive coding system comprehended herein allows improved fidelty due to the fact that each half of the speech spectrum is approximated by an independent curve without the constraint of continuity at the crossover frequency. This allows more degrees of freedom and should result in a better overall approximation as obtained by piecewise approximation of continuous functions. Also, degradation in one region of the spectrum do not affect the entire spectrum. System fidelity is further enhanced since the order of the two LPCs can be independently varied.

This permits the making of a better match of LPC coefficients to the spectrum (i.e., the LPC effort can be concentrated in the spectrum region where it will do the most good).

Figure 1:
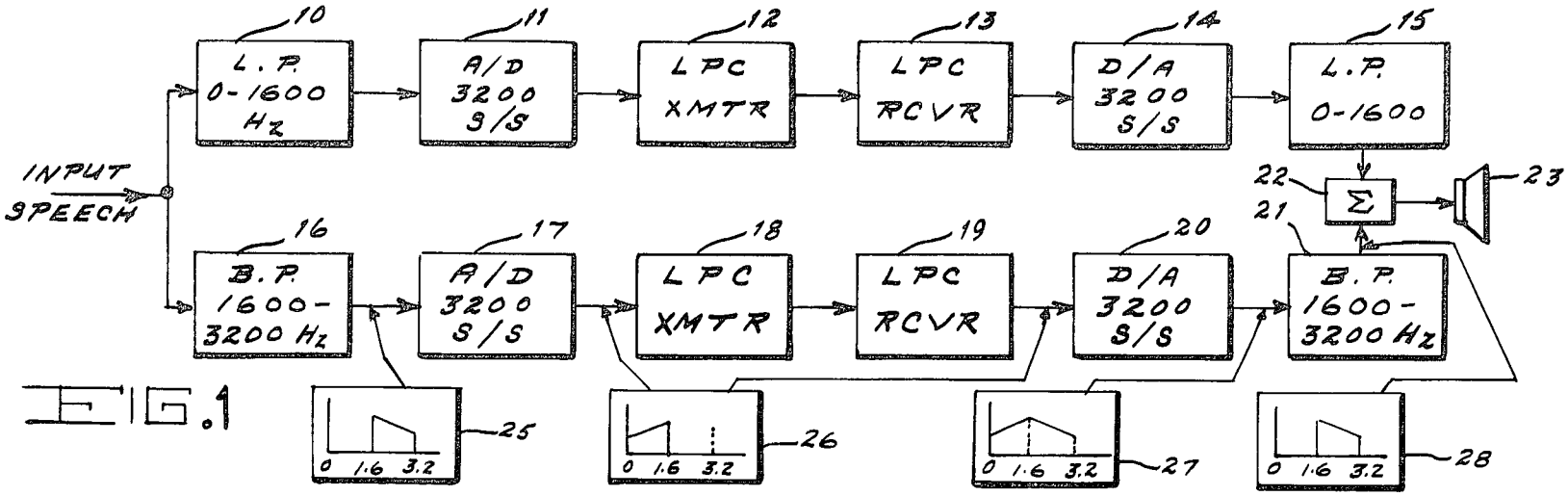
FIG. 1 is a block diagram of one presently preferred embodiment of the invention.

FIG. 1 of the drawings is a block diagram illustrating a two channel embodiment of the invention. The input signal is divided into two channels, a first consisting of low pass filter 10, analog to digital converter 11, standard LPC transmitter 12 and receiver 13, digital to analog converter 14 and low pass filter 15, and a second channel consisting of band paass filter 16, analog to digital converter 17, standard LPC transmitter 18 and receiver 19, digital to analog converter 20 and band pass filter 21. The outputs of the two channels are summed by summing means 22 and fed to speaker 23. Curves 25, 26, 27 and 28 illustrate the waveforms at the various indicated points in the circuit.

The processing for the lower half of the spectrum needs no explanation since this is the standard method of filtering, sampling and processing a 0–1600 Hz speech signal. In the 1600–3200 Hz channel, the speech is sampled at 3200 samples per second. This causes a complete spectrum folding of the 1600–3200 Hz signal into a 1600–0 Hz signal. Since there was no input power in the 0–1600 Hz region, a true folded symmetric spectrum of the 1600–3200 Hz signal is obtained. This signal is processed in the usual way resulting in an LPC approximation to the folded spectrum at the synthesizer output. When the folded spectrum is digital to analog converted at 3200 s/s by impulse-type digital to analog converter 20, the resulting spectrum consists of the folded spectrum from 0–1600 Hz and the desired (aliased) spectrum from 1600–3200 Hz. Both digital to analog filters 14 and 20 are adapted to reset to zero about 150 usec after conversion to prevent the output spectrum (especially the above portion) from being low pass filtered. Thus, the analog band pass filter selects the desired signal (16000–3200 Hz) which is combined with the low frequency channel to give the complete signal.

The PLPC system comprehended by the invention can also be implemented on a standard computer using digital filters with only two 0–3200 Hz low pass analog filters required. Such an implementation is illustrated by the block design of FIG. 2. Having reference thereto the input signal is filtered by low pass filter 29 and digitized by analog to digital converter 30 at a sampling rate of 6400 samples per second. The digitized signal is then digitally processed through two separate channels. The low frequency channel consists of low pass filter 31, LPC analysis circuit 35 (LPC transmitter), LPC synthesis circuit (LPC receiver) and low pass filter 39. The high frequency channel consists of band pass filter 32, LPC analysis circuit 35, LPC synthesis circuit 36 and band pass filter 40. The outputs of the channel are combined by summing means 41, digital to analog converted at a sample rate of 6400 samplers per period by digital to analog converter 42 and filtered by low pass filter 43. The sample rate in each channel is stepped down before the computer by sampling switches 37 and stepped up after the computer by sampling switches 38. Pitch extraction is performed in the conventional manner by means of low pass filter 33 and pitch extraction circuit 34.

Normally computers of the type used for such an application can perform no higher than a typical 11th order LPC before falling behind real time. However, in spite of the heavy computation load imposed by the four digital filters, the computational savings of the above described PLPC system allow real time operation of a 15th order PLPC system.

FIGS. 3*a* through 6*b* illustrate bulk spectrum curves that appear at various points in the PLPC system. The bulk spectrums shown in these figures were generated by making two channel analog tape recordings of the outputs at points indicated in FIG. 2. The source material was 21 sentences (50 seconds), seven sentences spoken by each of three male speakers. The recordings were analog to digital sampled at 6400 s/s and processed by a digital Fourier analyzer at a frame rate of 25 frames per second. The spectral power for all frames were added and plotted on an analog flat-bed plotter.

Figure 2:
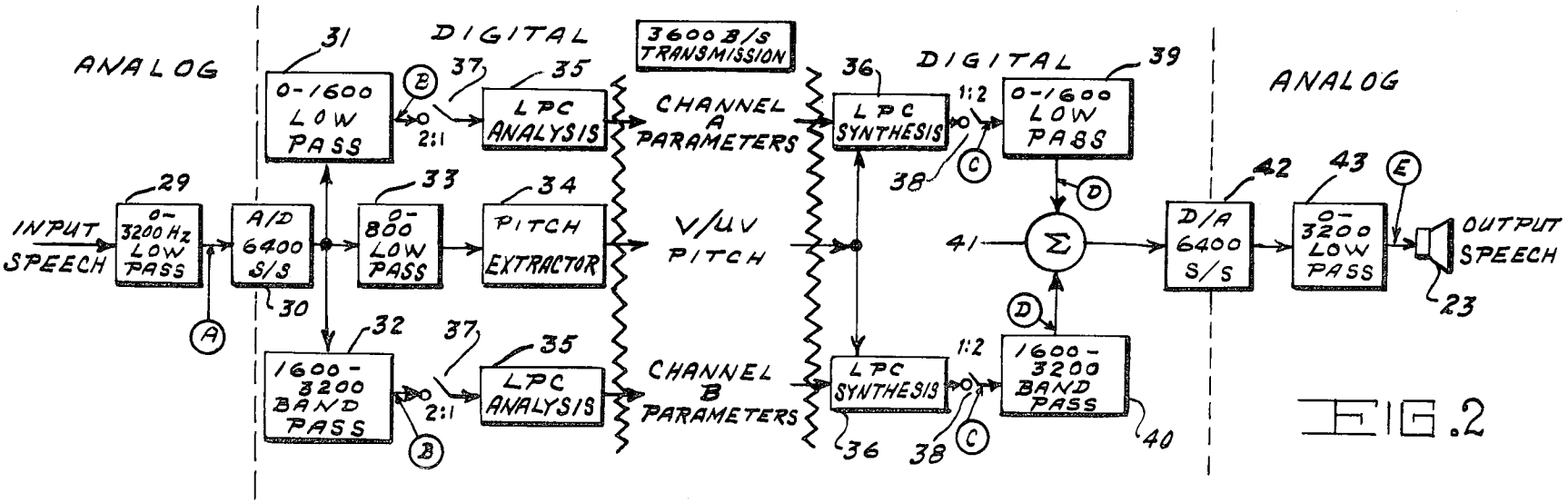
FIG. 2 is a block diagram of a computer implementation of the invention.
Figure 3A:
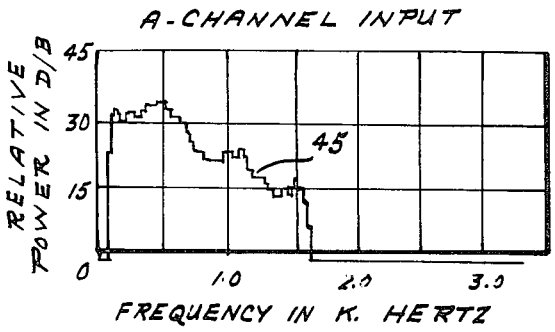
FIGS. 3*a* and 3*b* are graphs showing the bulk spectrum of the input to the LPC analyzer.
Figure 3B:
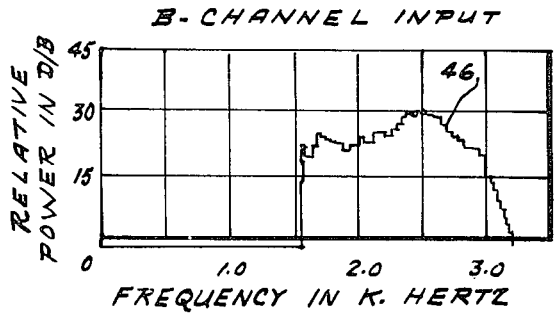
Figure 4A:
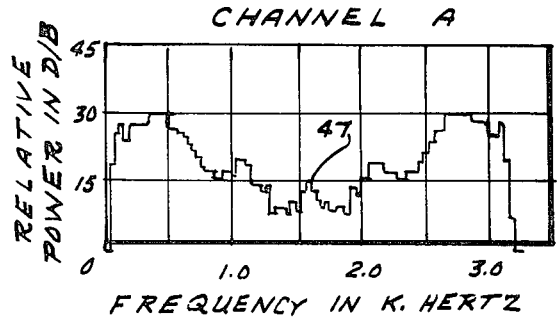
FIGS. 4*a* and 4*b* are graphs showing the output spectrum of the LPC synthesizers.
Figure 4B:
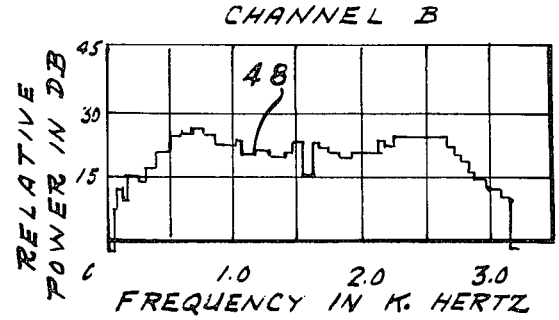
Figure 5A:
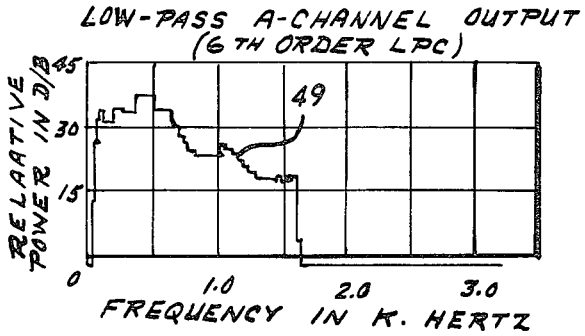
FIGS. 5*a* and 5*b* are graphs showing two-channel LPC outputs.
Figure 5B:
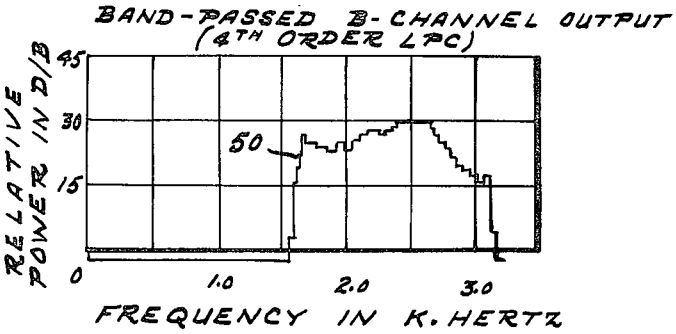
Figure 6A:
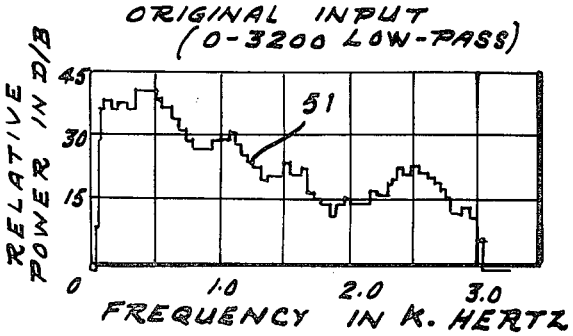
FIGS. 6*a* and 6*b* are graphs showing the original input and final LPC output.
Figure 6B:
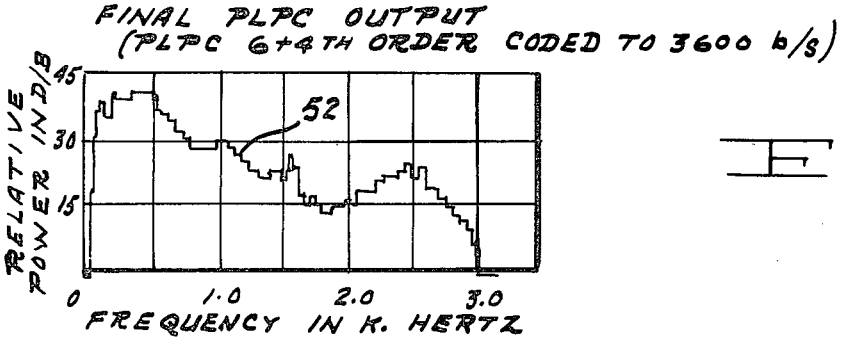

Curve 45 of FIG. 3*a* and curve 46 of FIG. 3*b* show the bulk spectrum of the two channels taken at points B in FIG. 2. Curve 47 of FIG. 4*a* and curve 48 of FIG. 4*b* show the PLPC synthesized output at points C. Curve 49 of FIG. 5*a* and curve 50 of FIG. 5*b* show the filtered PLPC outputs from points D. Curve 51 of FIG. 6*a* shows the original speech spectrum at the input (point A) and curve 52 of FIG. 6*b* shows the PLPC (10 + 8) final output at point E.

While the invention has been described in terms of its preferred embodiments, it is understood that the words which have been used are words of description rather than words of limitation and that changes within the purview of the appended claims may be made without departing from the scope and spirit of the invention in its broader aspects.

What is claimed is:

1. An LPC signal processing system comprising means for dividing an input analog signal into N contiguous, substantially equal bandwidth signal components, a separate LPC transmitting and receiving circuit connected to process each said signal component, each said LPC transmitting and receiving circuit having a sampling rate of $(2f_{max}/N)$, $f_{max}$ being the upper limit frequency of the input signal bandwidth, and means for summing the outputs of said LPC transmitting and receiving circuits.

2. An LPC signal processing system comprising filter means for dividing the system input analog signal into N contiguous, substantially equal bandwidth signal components, an analog to digital converter for digitizing each said signal component, each analog to digital converter having a sampling rate of $(2f_{max}/N)$, $f_{max}$ being the upper limit frequency of the input signal bandwidth, a separate LPC transmitting and receiving circuit connected to process the digitized output of each analog to digital converter, a digital to analog converter having a sampling rate of $(2f_{max}/N)$ connected to the output of each transmitter and receiving circuit, means for filtering the output of each digital to analog converter, and means for summing said filtered outputs.

3. An LPC signal processing system comprising a low pass filter for filtering the system input analog signal, an analog to digital converter connected to digitize said filtered input signal, said analog to digital converter having a sampling rate of $2f_{max}$, $f_{max}$ being equal to the upper frequency limit of said low pass filter, filter means for dividing the output of said analog to digital converter into $N$ contiguous substantially equal bandwidth signal components, an input sampling switch for sampling the outputs of each said filter means at a sampling rate of $(2 f_{max}/N)$, a separate LPC transmitting and receiving circuit connected to process the outputs of each input switch, an output sampling switch for sampling the outputs of each transmitting and receiving circuit at a sampling rate of $(N/2 f_{max})$, filter means for filtering the outputs of each output sampling switch, means for summing said filtered outputs, ad a digital to analog converter connected to the output of said summing means having a sampling rate of $2 f_{max}$.

* * * * *